US005586345A

United States Patent [19]

Nielsen et al.

[11] Patent Number: 5,586,345

[45] Date of Patent: Dec. 24, 1996

[54] MOBILE PORTABLE PLAYYARD SYSTEM

[75] Inventors: Robert A. Nielsen, Morgantown, Pa.; Vladimiro Pizzi, Scanzorosciate, Italy

[73] Assignee: Graco Children's Products, Elverson, Pa.

[21] Appl. No.: 556,057

[22] Filed: Nov. 9, 1995

[51] Int. Cl.[6] ..... A47D 7/00; B65D 65/02

[52] U.S. Cl. ..... 5/99.1; 5/98.1; 150/154

[58] Field of Search ..... 5/98.1, 99.1, 174; 190/2, 18.A; 150/154, 158; 256/25

[56] References Cited

U.S. PATENT DOCUMENTS

| | | | |
|---|---|---|---|
| 1,951,604 | 3/1934 | Friedlander | 150/158 X |
| 2,464,866 | 3/1949 | Holtz | 5/98.1 |
| 2,486,067 | 10/1949 | Schroeder | 5/99.1 |
| 2,958,084 | 11/1960 | Kenney | 5/98.1 X |
| 4,811,437 | 3/1989 | Dillner et al. | 5/99.1 |
| 5,170,826 | 12/1992 | Carstensen et al. | 150/154 |
| 5,212,841 | 5/1993 | Binnersley | 5/99.1 |

*Primary Examiner*—Michael F. Trettel

*Attorney, Agent, or Firm*—Morgan, Lewis and Bockius LLP

[57] ABSTRACT

A mobile portable playyard system is disclosed. The system generally includes a playyard structure for a child and a carrying case. In the folded position, the playyard structure is disposed within the carrying case. The playyard structure includes two wheels and the carrying case includes a towing strap for convenient transport of the system. The preferred bottom portion of the carrying case includes a member which provides stability to the wheels and to a pair of feet which extend therethrough. The member stabilizes the wheels and feet and insures that a minimum relative distance between the wheels and feet exists to provide for a stable support structure to maintain the system in an upright position. A carrying handle and a zippered closure are also provided.

17 Claims, 4 Drawing Sheets

MOBILE PORTABLE PLAYYARD SYSTEM

BACKGROUND OF THE INVENTION

1. Field of the Invention

The present invention relates to a mobile portable playyard system, and more particularly to a mobile portable playyard system that can be easily transported when the playyard is folded within a carrying case.

2. Description of the Related Art

Conventional playyards can be seen, for example, in U.S. Pat. No. 4,811,437 to Dillner et al., and may employ upper and lower frame assemblies that are joined by four rigid, tubular, metal corner legs which are supported at their lower end by four corner leg connecting members, respectively. The playyard folds together when the lower and upper frames are folded into a V-shape causing the four corner legs to collapse together. As a result, the entire playyard folds into a more compact, generally rectangular structure.

Although some conventional foldable playyard devices are not unduly heavy, they can be difficult to transport or carry for extended periods of time. Another disadvantage with the known devices is that they can be difficult to carry if the person carrying the playyard is also simultaneously transporting other items.

SUMMARY OF TEE INVENTION

Accordingly, an object of the present invention is to provide a mobile portable playyard system that is more easily transportable over extended distances. Another object of the present invention is to provide a mobile portable playyard system that can be more easily transported when the user is carrying other items.

To achieve these and other advantages and in accordance with the purpose of the invention, as embodied and broadly described, the invention provides for a mobile portable playyard system which is easily transportable, comprising a playyard structure which collapses into a generally rectangular shape including a plurality of corner legs, with at least one corner leg having a foot attached thereto and at least one corner leg having a wheel attached thereto. The system also comprises a carrying case having a top portion, a side portion, and a bottom portion, the bottom portion defining a wheel opening formed through the bottom portion such that the wheel can extend therethrough, and defining a foot opening formed through the bottom portion such that the foot can extend therethrough.

In another aspect, the invention provides for a carrying case for a mobile portable playyard system, the playyard having a plurality of corner legs with at least one wheel connected to a leg and at least one foot attached to another leg, comprising a flexible top portion, a plurality of flexible side portions, means for opening and closing the case, and a bottom portion defining a wheel opening formed through the bottom portion such that the wheel can extend therethrough, and defining a leg opening through the bottom portion such that the foot can extend therethrough.

It is to be understood that both the foregoing general description and the following detailed description are exemplary and explanatory and are intended to provide further explanation of the invention as claimed.

BRIEF DESCRIPTION OF THE DRAWINGS

The accompanying drawings, which are included to provide a further understanding of the invention, and are incorporated in and constitute a part of this specification, illustrate one embodiment of the invention and together with the written description, serve to explain the principles of the invention. In the drawings.

DETAILED DESCRIPTION OF THE PREFERRED EMBODIMENTS

Reference will now be made in detail to the preferred embodiment of the invention, an example of which is illustrated in the accompanying drawings.

Figure 1:
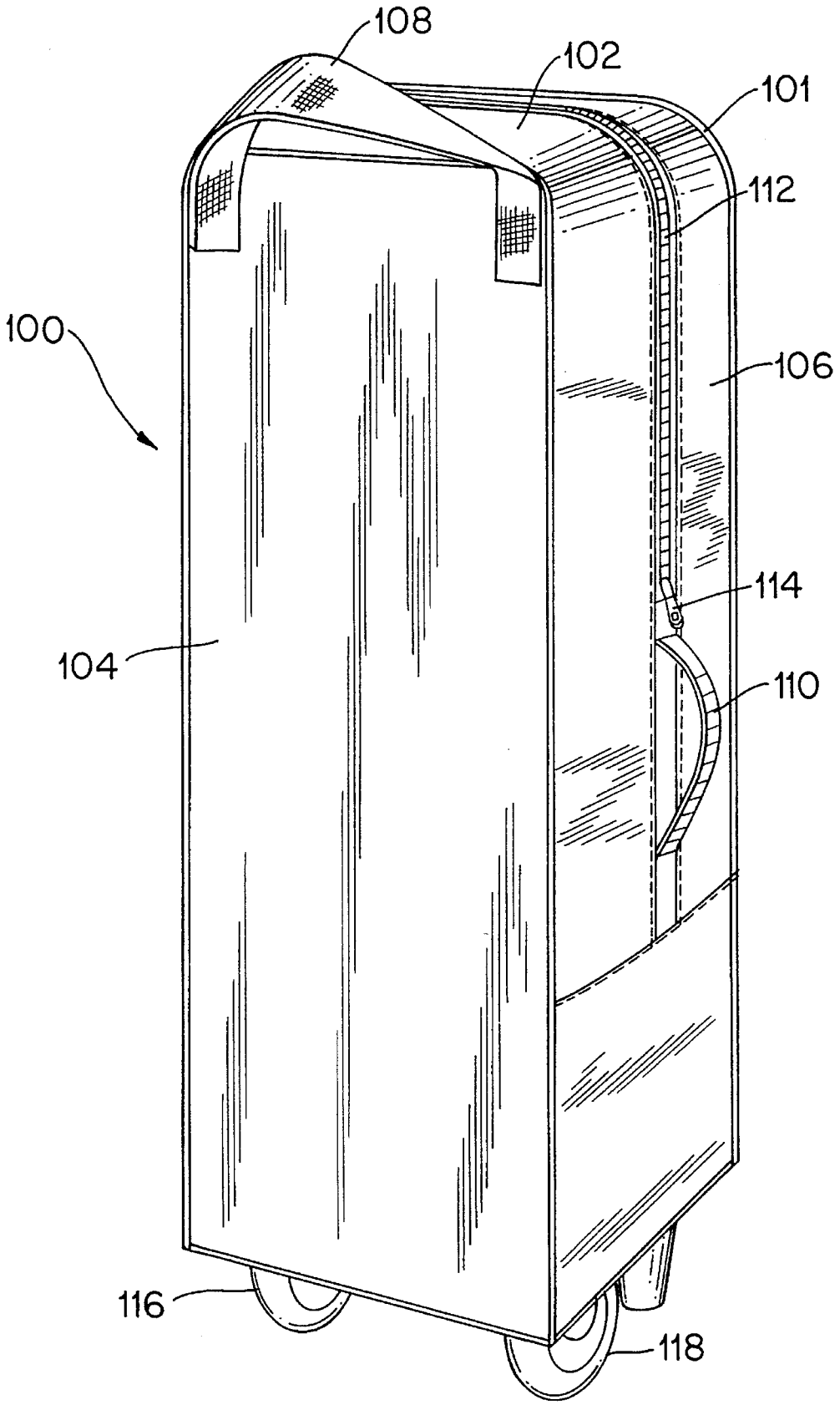
FIG. 1 is a perspective view of the mobile portable playyard system according to the present invention.

FIG. 1 shows a mobile portable playyard system 100 in accordance with the present invention. The system generally includes a carrying case 101 which includes a top portion 102, a plurality of side portions, two of which 104 and 106 are shown in FIG. 1, and a bottom portion more clearly shown in FIG. 3. In the preferred embodiment, the carrying case is comprised of a woven nylon material.

In the preferred embodiment, the system 100 includes a towing handle 108 attached near the top portion 102. A carrying handle 110 is shown on side 106, and facilitates the carrying of the system 100. Preferably, the carry handle 110 is connected to a bottom board (not shown) which wraps around the playyard structure (shown in FIG. 2) prior to placing the playyard structure 200 in the carrying case. In the unfolded position, a bottom board (not shown) may be placed as the floor of the playyard structure.

The system 100 further includes a means for opening and closing the carrying case 101. Specifically, FIG. 1 discloses a zipper 112 with an appropriate zipper tab 114 for opening and closing the carrying case 101.

During towing, the user may grasp the towing handle 108 and lean the system 100 onto a pair of wheels 116 and 118. The user may then tow the system 100 without having to lift its entire weight.

Figure 2:
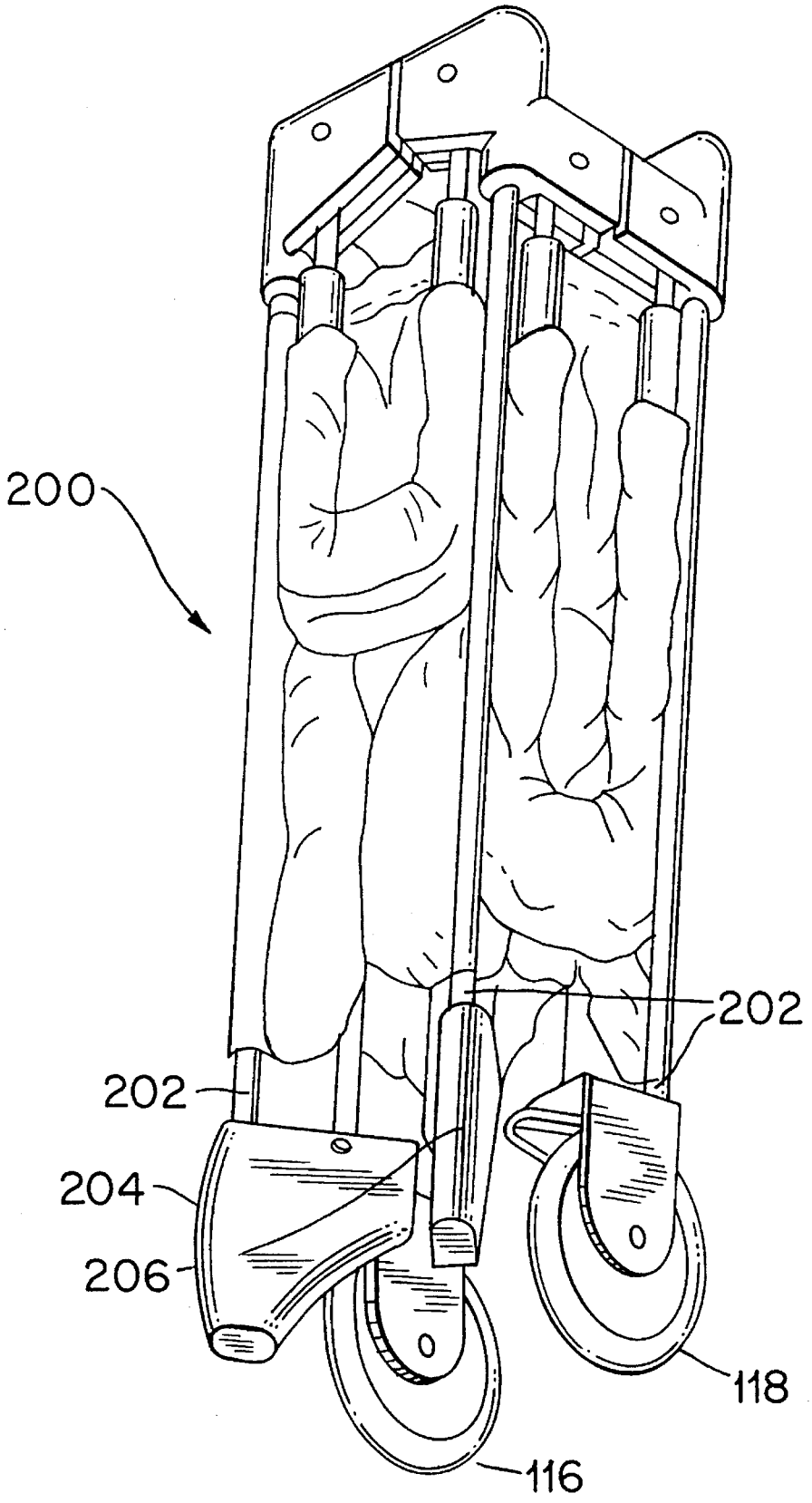
FIG. 2 is a perspective view of playyard structure in the folded position.

FIG. 2 generally shows a playyard structure 200 in the folded configuration. The playyard structure 200 includes a plurality of corner legs 202. In the preferred embodiment shown, four corner legs 202 are disclosed. First and second feet 204 and 206 are connected to first and second corner legs, respectively, and first and second wheels 116 and 118 are connected to third and fourth corner legs, respectively. As can be appreciated, the first and second wheels 208 and 210 also provide an advantage when the playyard structure is in the unfolded position (not shown). For example, a user may lift the first and second feet 204 and 206 off of the ground and easily move the unfolded playyard structure 200 on the wheels.

Figure 3:
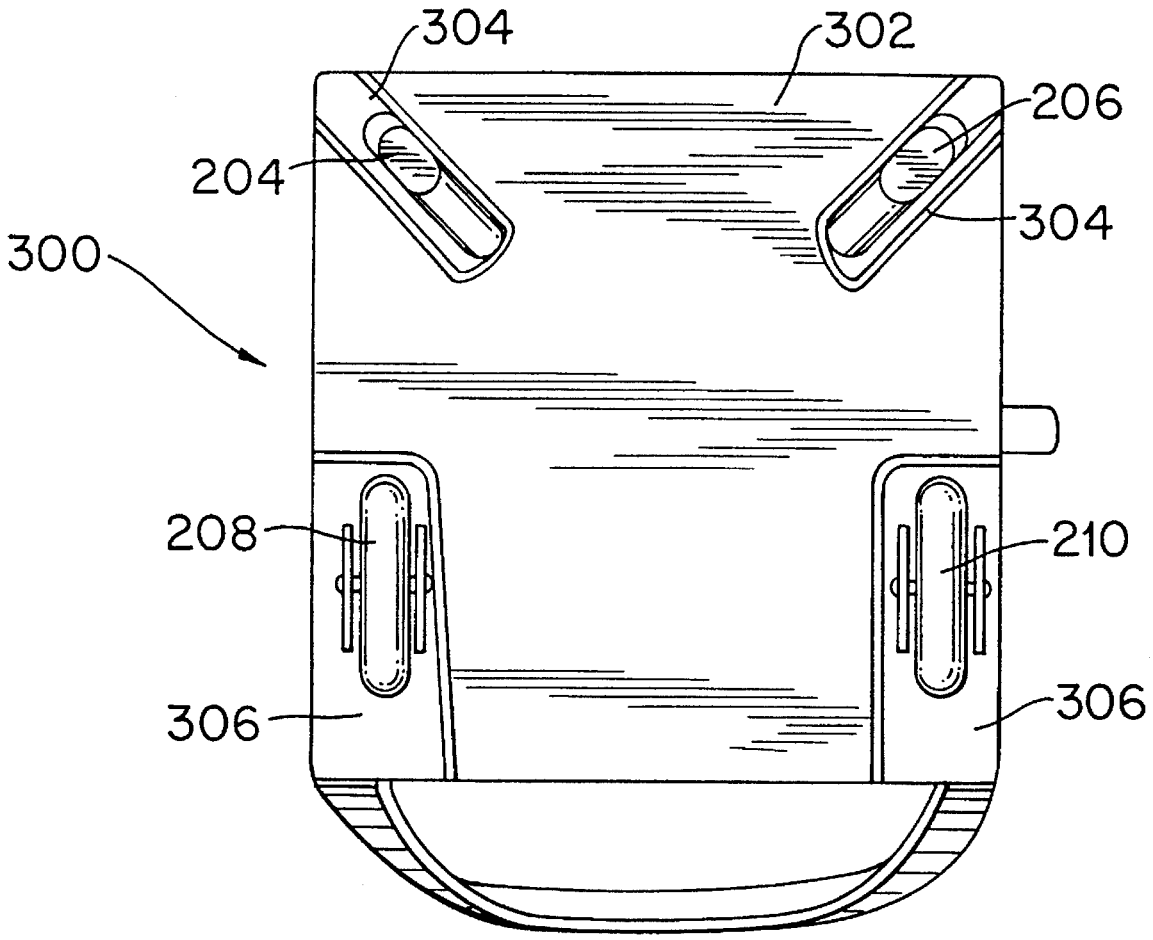
FIG. 3 is a bottom view of the mobile portable playyard system according to the present invention.

FIG. 3 shows a bottom portion 300 of the mobile portable playyard system 100 with the playyard structure 200 installed in the carrying case 101. First and second feet 204 and 206 are shown, as are first and second wheels 208 and 210.

A bottom structure 302 of the carrying case 101 is shown, and preferably includes two foot openings 304 which are formed through the bottom portion 302, and which allow the foot of the playyard structure 200 to extend therethrough. Similarly, the bottom portion 302 includes a wheel opening 306 formed through the bottom portion 302 such that a wheel can extend therethrough. The preferred implementation shown in FIG. 3 includes two foot openings 304 which allow first and second feet to extend therethrough, and two wheel openings 306 which allow first and second wheels 208 and 210 to extend therethrough.

Figure 4:
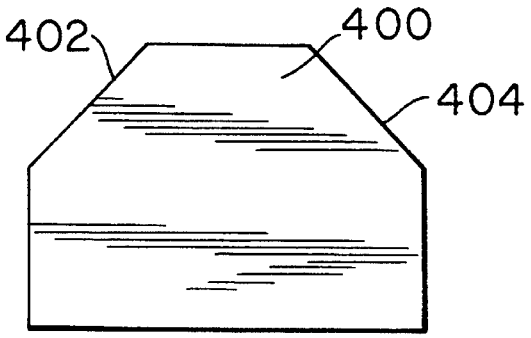
FIG. 4 is a plan view of the insert for the bottom of the carrying case according to a preferred embodiment of the present invention.

In accordance with the invention, the carrying case includes a support means adjacent to the bottom portion of the carrying case for providing stability between the first and second wheel openings. As shown in FIG. 4, a preferred embodiment of the support means includes a member 400 disposed between the first and second wheel openings. The member 400 comprises a flat, generally square structure, preferably formed of a rigid LDPE material or a semi-rigid foam material. The upper portion of the member 400 includes a first and a second truncated edge 402 and 404, as shown in FIG. 4.

Figure 5:
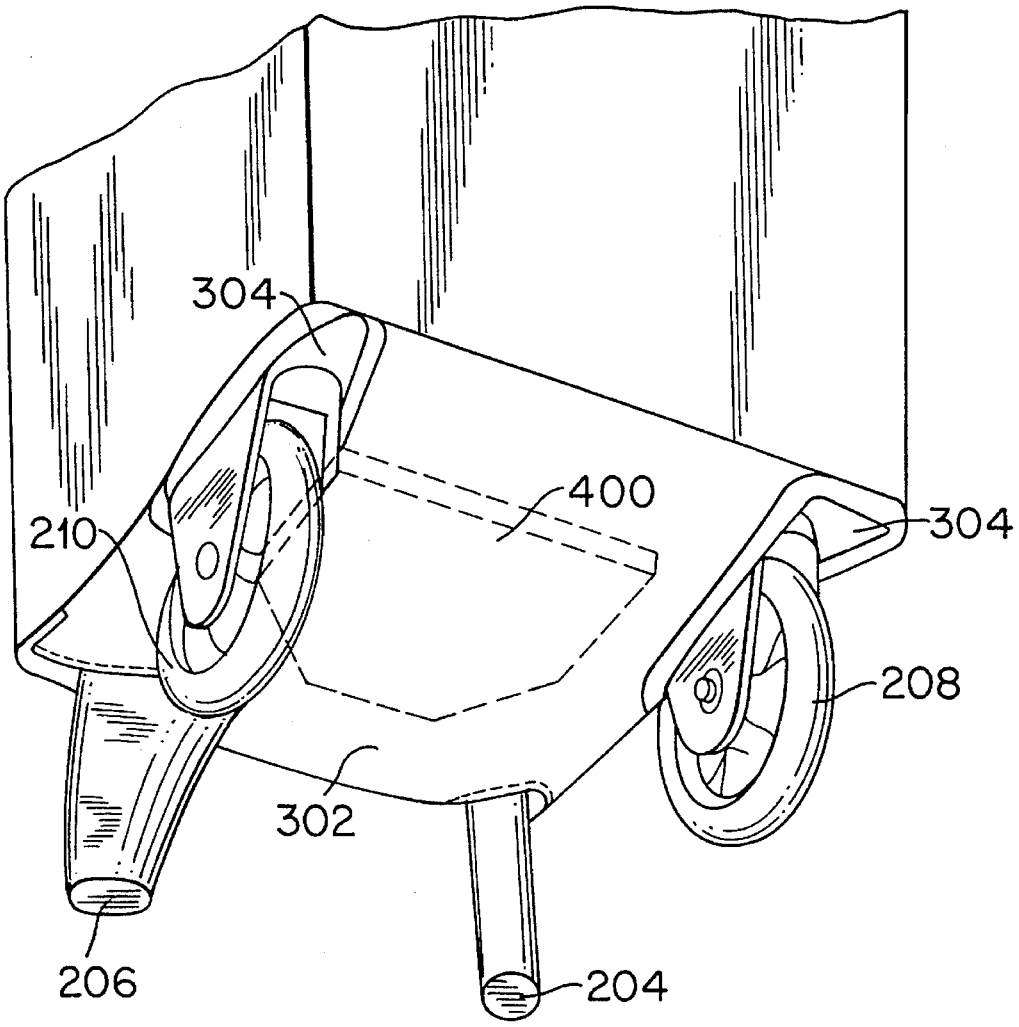
FIG. 5 is a perspective view of the mobile portable playyard system showing the location of the insert for the bottom of the carrying case according to a preferred embodiment of the present invention.

FIG. 5 shows a perspective view of the bottom portion 302 of the carrying case 101. The member 400 is shown in its general location within the bottom portion 302. In the preferred embodiment, the member 400 is sewn into the bottom portion of the carrying case 101.

The support means is preferably included to provide stability between the first and second wheel openings 304. For example, when the mobile portable playyard system 100 of the present invention is towed by the user, the wheels 208 and 210 may become unstable, wobble, or otherwise generally fail to perform in a satisfactory fashion. This problem is due in part to the lack of support and rigidity provided to the corner legs of the playyard structure when the playyard structure is in the folded position. During use, the system 100 may not tow easily, or may not follow the desired path set by the user.

To overcome this problem, the preferred embodiment of the present invention includes the support means. In particular, the member 400, which is preferably provided between and adjacent to the wheel openings 304, prevents the wheels 208 and 210 from being unstable or wobbly during use. The truncated edges 402 and 404 are provided to allow the foot openings 304 to extend inward toward the center of the bottom portion 302. As shown in FIG. 3, the first and second feet 204 and 206 extend in a generally diagonal direction from the corners of the bottom portion 302 toward the center, and the truncated edges of the member 400 are provided accordingly.

The truncated edges further provide support for the feet of the playyard structure and insure that the first and second wheels 208 and 210, and the first and second feet 204 and 206, maintain a minimum relative distance from each other to thereby provide a sufficiently broad base to support the system 100 during towing in an upright position. The broad base of the system 100 prevents and reduces the likelihood of tipping.

It will be apparent to those skilled in the art that various modifications and variations can be made in the mobile portable playyard system of the present invention without departing from the spirit or scope of the invention. Thus, it is intended that the present invention cover the modifications and variations of this invention provided they come within the scope of the appended claims and their equivalents.

What is claimed is:

1. A mobile portable playyard system which is easily transportable, comprising:

a playyard structure which collapses into a generally rectangular shape including a plurality of corner legs, at least one corner leg having a foot attached thereto and at least one corner leg having a wheel attached thereto; and a carrying case having a top portion, a side portion, and a bottom portion, the bottom portion defining a wheel opening formed through the bottom portion such that the wheel can extend therethrough, and defining a foot opening formed through the bottom portion such that the foot can extend therethrough.

2. The mobile portable playyard system of claim 1, wherein the playyard includes four corner legs, with first and second wheels attached to an end of first and second corner legs, and with first and second feet attached to an end of third and fourth corner legs.

3. The mobile portable playyard system of claim 2, wherein the carrying case includes first and second wheel openings to allow the first and seconds wheels to extend therethrough.

4. The mobile portable playyard system of claim 2, wherein the carrying case includes a support means adjacent to the bottom portion of the carrying case for providing stability between the first and second wheel openings.

5. The mobile portable playyard system of claim 4, wherein the support means comprises a member disposed between the first and second wheel openings.

6. The mobile portable playyard system of claim 5, wherein the rigid member comprises a flat, generally square-shaped structure with two truncated corners.

7. The mobile portable playyard system of claim 1, wherein the playyard structure includes a carrying handle, and wherein the side portion of the carrying case defines a handle opening to receive the carrying handle.

8. The mobile portable playyard system of claim 1, wherein the carrying case includes a towing handle located adjacent to the top of the carrying case and on a side adjacent the wheel opening for pulling the playyard on the wheel.

9. The mobile portable playyard system of claim 1, wherein the carrying case includes a means for opening and closing the carrying case.

10. A carrying case for a mobile portable playyard system, the playyard having a plurality of corner legs with at least one wheel connected to a leg and at least one foot attached to another leg, comprising:

a flexible top portion;

a plurality of flexible side portions;

means for opening and closing the case; and a bottom portion defining a wheel opening formed through the bottom portion such that the wheel can extend therethrough, and defining a leg opening formed through the bottom portion such that the foot can extend therethrough.

11. The carrying case for a mobile portable playyard system of claim 10, wherein the bottom portion includes first and second wheel openings.

12. The carrying case for a mobile portable playyard system of claim 10, wherein the carrying case includes a support means adjacent to the bottom portion of the carrying case for providing stability between the first and second wheel openings.

13. The carrying case for a mobile portable playyard system of claim 10, wherein the support means comprises a member disposed between the first and second wheel openings.

14. The carrying case for a mobile portable playyard system of claim 10, wherein the member comprises a flat, generally square-shaped structure with two truncated corners.

15. The carrying case for a mobile portable playyard system of claim 10, wherein the carrying case includes a towing handle located adjacent to the top of the carrying case and on a side adjacent the wheel opening for pulling the playyard on the wheel.

16. The carrying case for a mobile portable playyard system of claim 10, wherein the size of the wheel opening formed through the flexible housing is approximately equal to the size of at least one wheel.

17. The carrying case for a mobile portable playyard system of claim 10, wherein the carrying case is comprised of a woven nylon material.

* * * * *

US005586345C1

(12) EX PARTE REEXAMINATION CERTIFICATE (6825th)

United States Patent
Nielsen et al.

(10) Number: US 5,586,345 C1
(45) Certificate Issued: May 19, 2009

(54) MOBILE PORTABLE PLAYYARD SYSTEM

(75) Inventors: Robert A. Nielsen, Morgantown, PA (US); Vladimiro Pizzi, Scanzorosciate (IT)

(73) Assignee: Graco Children's Products, Inc., Elverson, PA (US)

Reexamination Request:
No. 90/009,036, Feb. 11, 2008

Reexamination Certificate for:

| | |
|---|---|
| Patent No.: | **5,586,345** |
| Issued: | **Dec. 24, 1996** |
| Appl. No.: | **08/556,057** |
| Filed: | **Nov. 9, 1995** |

(51) Int. Cl.
*A47D 07/00* (2006.01)
*B65D 65/02* (2006.01)

(52) U.S. Cl. ..... 5/99.1; 5/98.1; 150/154
(58) Field of Classification Search ..... None
See application file for complete search history.

(56) References Cited

U.S. PATENT DOCUMENTS

| | | | | | |
|---|---|---|---|---|---|
| 2,133,561 | A | * | 10/1938 | Thornton-Norris | 5/98.3 |
| 2,377,024 | A | | 5/1945 | Millek | |
| 2,626,407 | A | * | 1/1953 | Kurry | 5/99.1 |
| 2,781,526 | A | | 2/1957 | Zimmerman | |
| 3,018,493 | A | * | 1/1962 | Wittbrodt | 5/99.1 |
| 3,064,277 | A | | 11/1962 | Gill | |
| 4,811,437 | A | | 3/1989 | Dillner | |
| 5,170,826 | A | | 12/1992 | Carstensen | |
| 5,265,894 | A | | 11/1993 | Dunn | |
| 5,282,502 | A | | 2/1994 | Ballard | |
| 5,586,345 | A | | 12/1996 | Nielsen et al. | |

FOREIGN PATENT DOCUMENTS

| | | |
|---|---|---|
| WO | WO 94/00034 | 10/1964 |

* cited by examiner

*Primary Examiner*—Glenn K. Dawson

(57) ABSTRACT

A mobile portable playyard system is disclosed. The system generally includes a playyard structure for a child and a carrying case. In the folded position, the playyard structure is disposed within the carrying case. The playyard structure includes two wheels and the carrying case includes a towing strap for convenient transport of the system. The preferred bottom portion of the carrying case includes a member which provides stability to the wheels and to a pair of feet which extend therethrough. The member stabilizes the wheels and feet and insures that a minimum relative distance between the wheels and feet exists to provide for a stable support structure to maintain the system in an upright position. A carrying handle and a zippered closure are also provided.

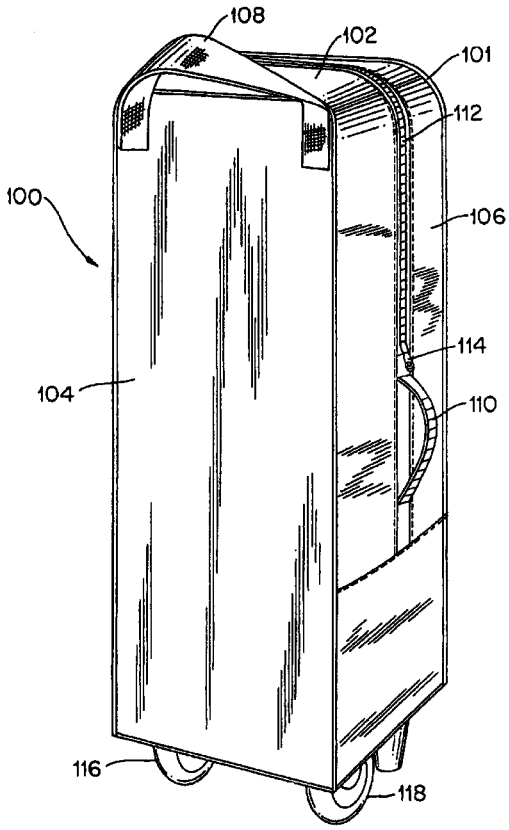

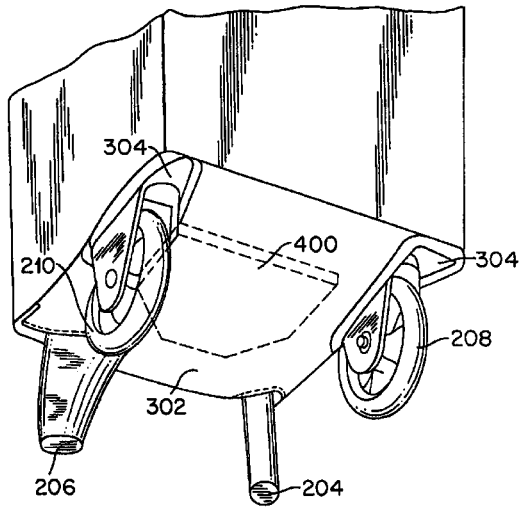

EX PARTE REEXAMINATION CERTIFICATE ISSUED UNDER 35 U.S.C. 307

THE PATENT IS HEREBY AMENDED AS INDICATED BELOW.

Matter enclosed in heavy brackets [ ] appeared in the patent, but has been deleted and is no longer a part of the patent; matter printed in italics indicates additions made to the patent.

AS A RESULT OF REEXAMINATION, IT HAS BEEN DETERMINED THAT:

Claims 6 and 14 are cancelled.

Claims 1, 4, 5, 10, 12 and 13 are determined to be patentable as amended.

Claims 2, 3, 7, 8, 9, 11 and 15–17, dependent on an amended claim, are determined to be patentable.

1. A mobile portable playyard system which is easily transportable, comprising:

a playyard structure which collapses into a generally rectangular shape including a plurality of corner legs, at least one corner leg having a foot attached thereto and at least one corner leg having a wheel attached thereto; and a carrying case having a top portion, a side portion, and a bottom portion, the bottom portion defining a wheel opening formed through the bottom portion such that the wheel can extend therethrough, and defining a foot opening formed through the bottom portion such that the foot can extend therethrough, *the bottom portion*

*having a support means adjacent thereto for providing stability, the support means comprising a flat, generally square-shaped structure with two truncated corners.*

4. The mobile portable playyard system of claim 2, wherein the [carrying case includes a] support means [adjacent to the bottom portion of the carrying case for providing] *provides* stability between the first and second wheel openings.

5. The mobile portable playyard system of claim 4, wherein the support means comprises a *rigid* member disposed between the first and second wheel openings.

10. A carrying case for a mobile portable playyard system, the playyard having a plurality of corner legs with at least one wheel connected to a leg and at least one foot attached to another leg, comprising:

a flexible top portion;

a plurality of flexible side portions;

means for opening and closing the case; and a bottom portion defining a wheel opening formed through the bottom portion such that the wheel can extend therethrough, and defining a leg opening formed through the bottom portion such that the foot can extend therethrough, *the bottom portion comprising a flat, generally square-shaped structure with two truncated corners.*

12. The carrying case for a mobile portable playyard system of claim [10] *11*, wherein the carrying case includes a support means adjacent to the bottom portion of the carrying case for providing stability between the first and second wheel openings.

13. The carrying case for a mobile portable playyard system of claim [10] *12*, wherein the support means comprises a member disposed between the first and second wheel openings.

* * * * *